US005510774A

United States Patent [19]

Phillips

[11] Patent Number: 5,510,774

[45] Date of Patent: Apr. 23, 1996

[54] ENERGY EFFICIENT INDEPENDENT ALARM SYSTEM

[76] Inventor: Kurt R. Phillips, 855 W. Dillon Rd., #I305, Louisville, Colo. 80027

[21] Appl. No.: 68,407

[22] Filed: May 27, 1993

[51] Int. Cl.[6] ..... G08B 13/08; G08B 13/14

[52] U.S. Cl. ..... 340/689; 340/506; 340/546; 340/566; 340/636; 340/693

[58] Field of Search ..... 340/689, 566, 340/546, 636, 693, 506

[56] References Cited

U.S. PATENT DOCUMENTS

| | | | |
|---|---|---|---|
| 3,192,517 | 6/1965 | Werlin | 340/546 |
| 3,345,627 | 10/1967 | Herst et al. | 340/546 |
| 3,432,843 | 3/1969 | Spring | 340/546 |
| 3,579,222 | 5/1971 | Freeman | 340/541 |
| 3,916,376 | 10/1975 | Tuttle | 340/693 |
| 4,123,752 | 10/1978 | Novotny | 340/545 |
| 4,264,892 | 4/1981 | Zonn | 340/521 |
| 4,264,899 | 4/1981 | Menzies et al. | 340/546 |
| 4,338,596 | 7/1982 | Huber et al. | 340/636 |
| 4,667,188 | 5/1987 | Schwartz | 340/689 |
| 4,673,928 | 6/1987 | Guim | 340/693 |
| 5,093,650 | 3/1992 | Kolbatz | 340/521 |
| 5,107,249 | 4/1992 | Johnson | 340/541 |
| 5,144,283 | 9/1992 | Arens et al. | 340/546 |

*Primary Examiner*—Glen Swann
*Attorney, Agent, or Firm*—Donald W. Margolis

[57] ABSTRACT

An independent alarm system which is carried by a housing member designed to be located adjacent to or within building openings, and at various other site locations, or adjacent to specific to-be-protected objects. The housing member is free standing, for example, swingably suspended from a window frame, ceiling or a separate frame. The housing member has an agitation sensor and a proximity or tilt sensor incorporated therein and electrically wired to a first signal. When the housing member is agitated while in its original position, or when it is moved from its original position to a second position, the agitation sensor and/or the proximity/tilt sensor is activated, which in turn causes the first signal to be actuated. The agitation and proximity/tilt sensors are both battery powered. By being pulsed, the alarm circuit may be always "on", yet be fully operational for a period of thirty six months, and greater using a single set of batteries. In preferred embodiments, the pulsed alarm circuit includes an indicator, such as an LED, to indicate whether the system is operating, and also to indicate whether the battery has nominal stored energy, low energy, or no energy. The pulsed alarm circuit also includes a tampering sensor which, when triggered, causes a second signal to be activated.

16 Claims, 3 Drawing Sheets

$y=-3.17E-9x^3+3.34E-6x^2-0.00157x^1+1.52$ var:1.73E-4. max dev:0.0423

ENERGY EFFICIENT INDEPENDENT ALARM SYSTEM

BACKGROUND OF THE INVENTION

1. Field of the Invention

The present invention relates to an electrical communications indicating system which is responsive to a specific condition. More specifically, it relates independent alarm system having an electrically powered alarm circuit which requires low electric power consumption which is carried by a housing member, such as a frame, which can be inconspicuously located, for example, by suspension in front of a door or window opening, and is activated by movement or agitation.

2. Description of the Prior Art

Heretofore there have been a variety of different types of portable alarms, burglar alarms and signal devices described in Herst et al. U.S. Pat. No. 3,345,627; Spring U.S. Pat. No. 3,432,843; Freeman U.S. Pat. No. 3,579,222; Novotny U.S. Pat. No. 4,123,752; Zonn U.S. Pat. No. 4,264,892; Menzies et al. U.S. Pat. No. 4,264,899; Schwartz U.S. Pat. No. 4,667,188; Kolbatz U.S. Pat. No. 5,093,650; and Johnson U.S. Pat. No. 5,107,249. None of the above mentioned references disclose or teach the unique features and function of the subject independent alarm system as described herein.

SUMMARY OF THE INVENTION

It is an object of the present invention to provide an electrically powered alarm system carried by a housing member which is independent from the surrounding environment, and which requires no special installation or connection to an external electrical power source.

Another object of the present invention is the provision of such an electrically powered alarm system which is battery operated so that no outside power source is required which would be subject to tampering or to random interruptions.

Yet another object of the present invention is to provide such a battery operated independent alarm system which has a circuit and an alarm which requires an extremely low electrical power consumption, so that the system is capable of operating over an extended period of time.

Still another object of the present invention is the provision of such a reliable, self-contained, independent alarm system which can be hung or suspended to guard building openings, objects in a building, and for other security applications.

Still yet, another object of the present invention is the provision of such a battery operated independent alarm system which includes, in addition to intruder alert and intruder deterrence provisions, a tampering avoidance signal.

Yet another object of the present invention is the provision of such a system which offers security while avoiding false alarms, and which does not require ongoing maintenance.

Another object of the present invention is the provision of such a system which is capable of being always "on", and which therefore does not require the arming and disarming of the alarm system during everyday use.

A further object of the independent alarm system of the present invention is the inclusion of an indicator which a user may easily examine to determine whether the alarm is functioning properly, the condition of the battery, and whether the circuit or sensor has failed.

The foregoing objects of the present invention are accomplished by an independent alarm system which is carried by a housing member, such as a frame, a panel, or the like. The housing member is designed to be located adjacent to or within building openings, such as windows, doors, sky lights, and the like. It may also be located at various other site locations, such as walls, ceilings, adjacent to specific to-be-protected objects, and the like. The independent alarm system is characterized by the housing member being free standing, for example, swingably suspended from a window frame, ceiling or a separate frame. As such, it is reliable for securing different types and sizes of building openings and securing different types of objects hung or suspended while providing for intruder alert and deterrence.

The housing member has an agitation sensor and a proximity or tilt sensor incorporated therein and electrically wired to a first signal. When the housing member is agitated while in its original position, or when it is moved from a fixed original position to a second position, the agitation sensor and/or the proximity/tilt sensor is activated, which in turn causes the first signal to be actuated. The agitation and proximity/tilt sensors are both connected, for example by wire, to a pulsed alarm circuit which is battery powered. By being pulsed, the alarm circuit may be always on, yet uses only a fraction of the electrical energy that it would use if it were not pulsed. For example, the independent alarm system of the present invention may remain always "on", yet be fully operational for a period of thirty six months and greater using a single set of batteries, as detailed below. In preferred embodiments, the pulsed alarm circuit includes an indicator, such as an LED, to indicate whether the system is operating, and also to indicate whether the battery has nominal stored energy, low energy, or no energy. The pulsed alarm circuit also includes a tampering sensor which, when triggered, causes a second signal to be activated.

These and other objects of the present invention will become apparent to those skilled in the art from the following detailed description, showing the contemplated novel construction, combination, and elements as herein described, and more particularly defined by the appended claims, it being understood that changes in the precise embodiments to the herein disclosed invention are meant to be included as coming within the scope of the claims, except insofar as they may be precluded by the prior art.

BRIEF DESCRIPTION OF THE DRAWINGS

The accompanying drawings illustrate complete preferred embodiments of the present invention according to the best modes presently devised for the practical application of the principles thereof, and in which.

DESCRIPTION OF THE PREFERRED EMBODIMENT

Figure 1:
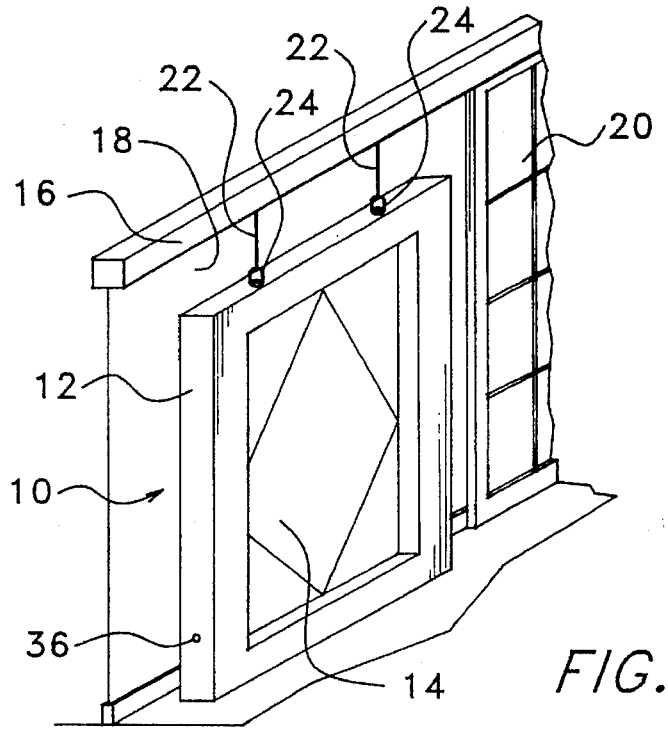
FIG. 1 is a top, front perspective view of the present invention shown incorporated into a stained glass window frame housing member and suspended in front of a window of a building.

Referring to FIGS. 1 the subject independent alarm system is designated by general reference numeral 10 and is shown incorporated into an alarm system housing member, in this case frame 12, which has a decorative stained glass window 14 mounted therein. The use of stained glass window 14 camouflages the nature of alarm system 10. The alarm system frame 12 is shown suspended from a window frame 16 having an opening 18 and a sliding glass window 20 which has been moved to the right, in this figure, to create that opening 18. The alarm system frame 12 is suspended from the window frame 16 using hangers 22 attached to a pair of loops 24 which are connected to alarm system frame 12. The loops 24 can be seen more clearly in FIG. 2.

Figure 2:
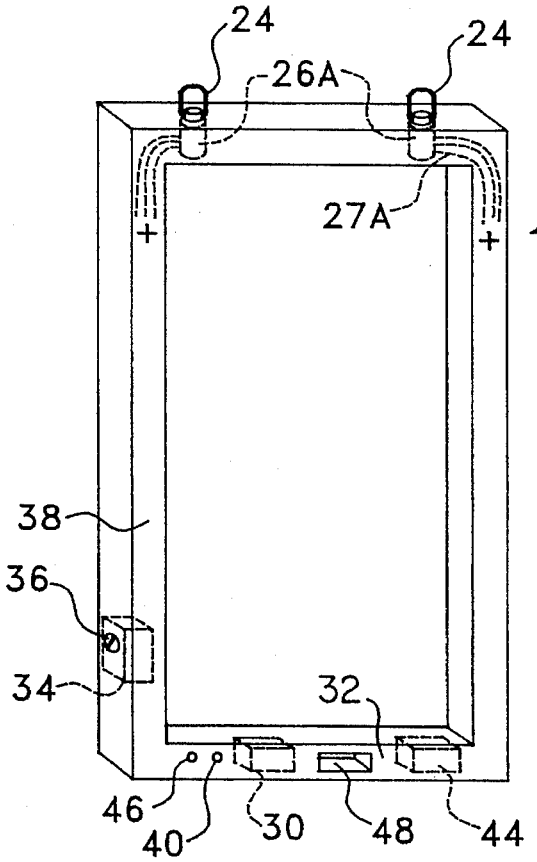
FIG. 2 is a top, front perspective view of a window frame similar to that shown in FIG. 1, and illustrating the location of the sensors, alarm status indicator and some of the pulsed circuit components, of the independent alarm system of the present invention.

Referring now to both FIGS. 1 and 2, the alarm system 10 includes a pair of spring actuated agitation sensors 26A and 27A inside a top portion 28 of the alarm system frame 12. The sensors 26A and 27A are attached to the bottom of the loops 24, and are wired to a first signal element 30 which is located inside of a bottom portion 32 of the frame 12. The complete wiring of the system 10 is not shown in FIG. 2, but is shown in detail in electrical circuit diagram in FIG. 3. First signal 30 is an audio alarm, a light, or a similar alerting device. When the alarm system frame 12 is agitated by moving the frame 12 either to the left or to the right or by removing loops 24 from hangers 22, thereby activating first signal 30. System 10 also includes a proximity/tilt sensor 34 which is mounted in a side portion 38 of the frame 12, and which is also wired to the first signal 30. Sensor 34 has a sensitivity adjustment screw 36. When alarm system frame 12 is tilted and moved away from or moved toward the opening 18, the proximity/tilt sensor 34 is triggered and the first signal 30 energized. By adjusting the screw 36, the sensitivity of the proximity/tilt sensor 34 to tilting can be increased or decreased.

Figure 3:
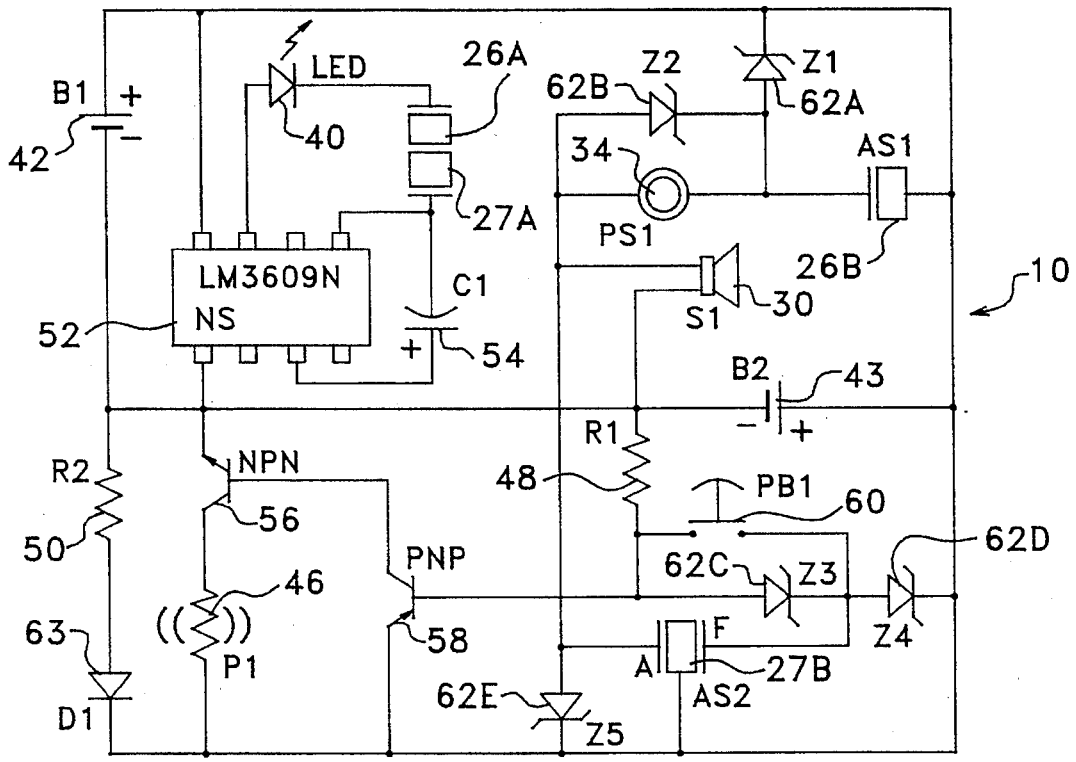
FIG. 3 is an electrical schematic of the pulsed circuit of the independent alarm system of the present invention.

In the bottom portion 32 of the frame 12 are a pair of battery units 42 and 43 which are connected in parallel, see FIG. 3, and stored in a battery compartment 44. A signal device, such as an LED 40, is powered by battery units 42 and 43. LED 40 is used as an indicator to show that the system 10 is operational and also whether battery units 42 and 43 have low energy or no energy. The battery units 42 and 43 are also wired to second signal 46 for sounding an alarm should someone tamper with the components of the alarm system 10. The second signal 46 may also be an audio alarm, a light alarm or a similar device. Also shown in FIG. 2 is a circuit storage compartment 48 for receiving the control portion of the electrical circuit shown in FIG. 3. It is thus seen that the present invention provides an electrically powered alarm system carried by a housing member which is independent from the surrounding environment, and which requires no special installation or connection to an external electrical power source.

It should be noted that while the alarm system 10 is shown received in the alarm system frame 12, the alarm system 10 can be mounted equally well in a variety of different size and shaped housing members such as frames and panels placed in various locations in a building structure.

Referring again to FIG. 3, the circuit of alarm system 10 is shown to be designed with state-of-the-art components which not only provide satisfactory operation, but also so that electric power dissipation is kept to a minimum. For example, since all resistors are a power sink, dissipating energy without providing any function, the circuit includes only one resistor 48 through which current flows under normal always "on" operation. A second resistor 50 is present, but current does not flow through it under normal always "on" operation. The branch of the circuit including resistor 50 serves to eliminate the chance of damage to the circuit should the battery units 42 and 43 be inserted with reverse polarity.

A capacitor 54 controls the current pulse frequency and magnitude. An oscillator/amplifier semiconductor chip 52 is used in the circuit for creating a sampling pulse and also to amplify the voltage of the pulse so a bright illumination of the LED 40 is possible under nominal energy operations. A typical voltage necessary to illuminate the LED 40 is 1.8 volts, which is greater than the voltage applied to the circuit. Thus, amplification of the pulse to the LED 40 provides distinct illumination, without the need for the circuit to operate at a voltage of 1.8 volts or higher. Changing either of these quantities by varying the value of capacitance used will ultimately determine the energy dissipated in the circuit.

A pair of transistors 56 and 58 are oriented in the circuit to create a high current gain from a fail safe loop to a piezoelectric crystal, which is the second signal 46. The fail safe loop is made up of the agitation sensor 27, a tampering sensor 60, in the form of a push button switch, and first resistor 48. The current in the fail safe loop is 0.01 milliamp, and the optimum current to operate the second signal 46 is 0.54 milliamp. Thus, a minimum current gain of 54 (0.54 divided by 0.01) is required to operate the second signal device 46. The combined short circuit gain of transistors 56 and 58 is 5000, but under loaded conditions the total gain is approximately 54. The transistors 56 and 58 are loaded by the second signal device 46 and the first resistor 48, which have resistances of 1850 ohms and 250 kilo-ohms, respectively. The current is present in the fail safe loop under normal always "on" operation.

Should the circuit is disrupted, the second signal 46 will be activated, thereby giving a warning of malfunction or tampering. Duplicate sets of sensors 26A and 26B, and 27A and 27B are provided in the circuit for back-up redundancy. However, each sensor in each set of sensors 26A and 26B, and 27A and 27B operate to provide the same function. As shown in FIG. 3., each sensor is connected to a different terminal of controller chip 52, Zener diodes 62A, 62B, 62C, 62D and 62E are provided within the circuit in order to protect controller chip 52 from voltage spikes that may occur when the sensors are tripped. For example, Zener diodes 62D and 62E, guard against voltage spikes from agitation sensor 27B to the associated terminals of controller chip 52. Similarly, Zener diodes 62A, 62B and 62C guard against voltage spikes from agitation sensor 26B, proximity sensor 34 and tampering sensor 60, respectfully, to the associated terminals of controller chip 52. While not required for operation of the circuit, this arrangement allows controller chip 52 to be isolated from electrical damage. A diode 63 is used to restrict the flow of current through the resistor 50 when the battery units 42 or 43 is inserted with the correct polarity, but allows current to flow through the dissipating resistor 50, thereby serving to eliminate the chance of damage to the circuit when the battery units 42 or 43 is inserted with incorrect polarity.

The independent alarm system 10 has two levels of alarm. This is done to comply with the milliampere hour limits on the combined battery units 42 or 43. The first signal 30, is selected to draw about 14.5 milliamps and which produces an 85 dB sound compression, is for an intruder alert, and is triggered by the activation of agitation sensors 26A and 27A, and/or proximity/tilt sensor 34. The second signal 46, which produces a high pitched tone, requires much less current, is triggered by the activation of the fail safe portion of the circuit. Since the second signal 46 warns a user of the system 10 of a malfunction or tampering, and may last for a long duration, high dissipation of the battery power by the second signal 46 is undesirable. In the case of the first signal 30, effective intruder alert and deterrence, rather power dissipation, is of major concern.

The trigger time for the agitation sensors 26A and 27A and the proximity/tilt sensor 34 is substantially instantaneous. The first signal 30 will sound immediately upon any disturbance of sensors 26 and 27 and/or disturbance of proximity/tilt sensor 34. Changing the sensitivity of the proximity/tilt sensor 34 via the adjustment screw 36 will not change the trigger time of the sensor 34. The trigger time for the fail safe loop is limited to the switching speed of the combination of the transistors 56 and 58, and is on the order of a few milliseconds. Under normal operation, both transistors are off. If for any reason the current in the fail safe loop is disrupted, the second transistor 58 will be forced on, which will turn the first transistor 56 on and allow current to flow to the second signal 46. All of the devices in the alarm system 10 are reset automatically when malfunctions are corrected or when a dead battery unit 42 or 43 is replaced.

Figure 4:
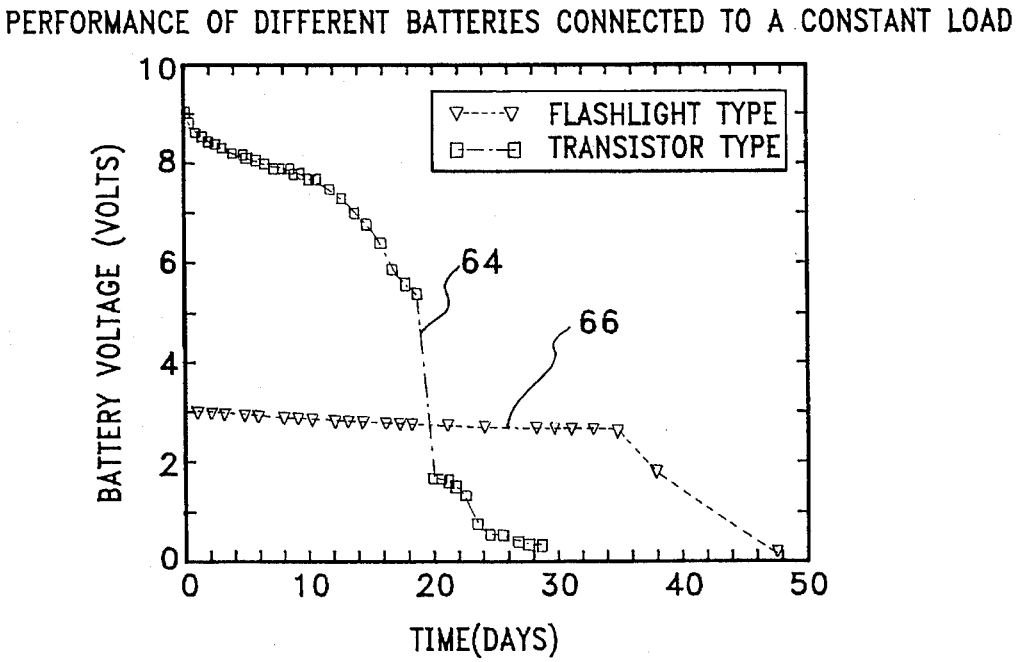
FIG. 4 is a graph showing the estimated energy levels over time, and thereby the battery life, of two different types of commercial batteries used in a prior art circuit and connected to a constant load.
Figure 5:
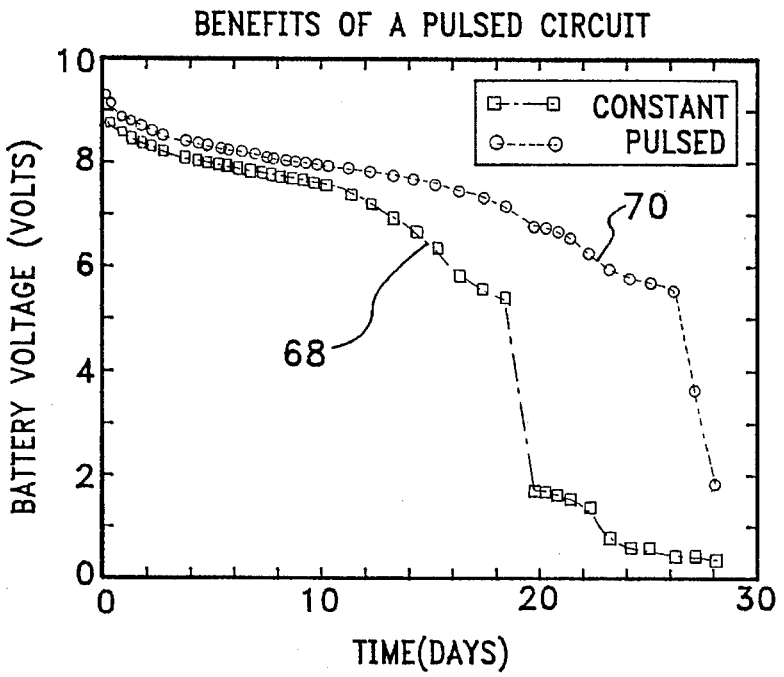
FIG. 5 is a graph showing the estimated energy levels over time, and thereby the battery life, of two different types of commercial batteries used with a pulsed alarm circuit.
Figure 6:
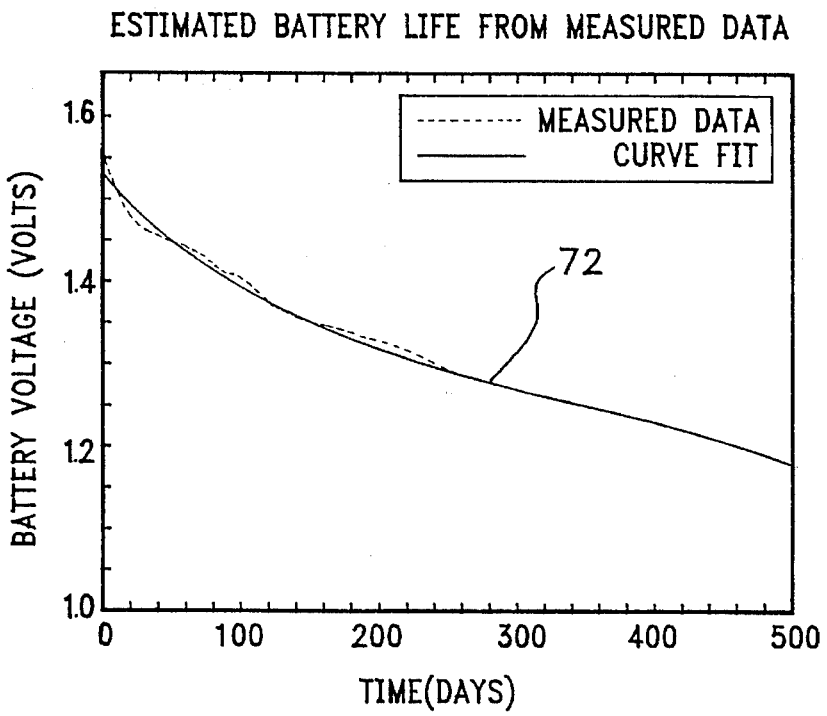
FIG. 6 is a graph showing the estimated battery life of a battery used with the pulsed alarm circuit of the present invention.

Referring now to FIGS. 4–6, it is important to point out that the life of the batteries in alarm system 10 is of the highest concern. Different batteries provide different durations of operation. In FIG. 4, the results of the alarm circuit configured for a 9 volt transistor type battery, and a 3 volt battery unit, e.g. two AA, C or D batteries connected in series, is illustrated. By comparison, the 9 volt transistor type battery, represented by line 64 of the graph of FIG. 4, dissipates a high percentage of power in resistors, which ultimately results in shorter battery life. The two 1.5 volt batteries (AA, C and D cells) all have milliampere-hour (mAh) ratings much higher than transistor batteries. This fact is verified in FIG. 4, wherein the two 1.5 volt flashlight type battery life is represented by line 66. As a result of the performance, as illustrated in FIG. 4, alarm system 10 is designed to operate on two 1.5 volts C cell batteries connected in parallel.

For a battery operated circuit such as that of system 10, the quantity of electric current is the controlling value in determining the power consumed by the circuit. The power dissipated in a circuit is computed by the equation, Power= Volts ×Current, wherein units are in milliwatts, volts, and milliamperes, respectively. The voltage applied to the circuit remains relatively constant, and is equal to the voltage of the battery. Therefore, the current in the circuit is a quantity that should be kept to a minimum to ensure low power consumption by the alarm system 10.

The indication circuitry of the alarm system 10 or the LED 40 uses the highest level of electrical current. The LED 40 verifies that the alarm system 10 is functioning properly. The LED 40 alerts the user of the alarm system 10 when the battery voltage is getting low, so that the battery unit 42 or 43 can be replaced without an interruption in service. Since the LED 40 has a continuous function, it is the source of greatest power dissipation and highest design concern. In FIG. 5, line 68 illustrates what is representative of a shortened battery life when a constant current source is applied to the LED 40. Line 70 illustrates what is representative of an extended battery life when a pulsed current source to the LED 40. By pulsing the current to LED 40, and in effect flashing the armed LED 40, it is possible to increase the life of the the combined battery units 42 and 43 to an acceptable value.

In FIG. 6, estimated battery life was measured using a single AA cell battery. Using two C cell batteries, it was found to have a lifetime of 2.4 times that of a single AA cell battery. The battery life for a single AA cell battery is illustrated as line 72. An estimated lifetime of one such set of batteries can be computed by using an equation scaled for two C cells. The scale factor is based on manufacturers specifications of alkaline battery life given in terms of milliampere hours (Mah) and a factor of 2, since the two C cells will be connected in parallel. From the equation set forth in FIG. 6, X is set equal to the duration of days, and the result Y is the remaining voltage level of 1.297 volts. In conclusion, the subject independent alarm system 10 is found to be fully operational for a period greater than thirty six months on a single set of batteries.

It is thus seen that the present invention provides an electrically powered alarm system carried by a housing member which is independent from the surrounding environment, and which requires no special installation or connection to an external electrical power source. It provides an electrically powered alarm system which is battery operated so that no outside power source is required which would be subject to tampering or to random interruptions. The alarm system includes, in addition to an intruder alert and intruder deterrence provisions, a tampering avoidance signal. It has a circuit and an alarm which requires an extremely low electrical power consumption, so that the system is capable of operating over an extended period of time. It also includes an indicator which a user may easily examine to determine whether the alarm is functioning properly, the condition of the battery, and whether the circuit or sensor has failed. As such, it provides a reliable, self-contained, independent alarm system which can be hung or suspended to guard building openings, objects in a building, and for other security or tampering applications. It is also seen that it provides a system which offers security while avoiding false alarms, and which does not require ongoing maintenance which is designed to be "on" and which therefore does not require arming and disarming during everyday use.

While the invention has been particularly shown, described and illustrated in detail with reference to the preferred embodiments and modifications thereof, it should be understood by those skilled in the art that equivalent changes in form and detail may be made therein without departing from the true spirit and scope of the invention as claimed, except as precluded by the prior art.

The embodiments of the invention for which an exclusive privilege and property right is claimed are defined as follows:

1. An electrically powered alarm system, including in combination:

a portable housing member which is independent from the surrounding environment, and which requires no connection to an external electrical power source;

means for receiving a battery unit as a source of electric power carried by said housing member;

circuit means for the alarm system for consuming electric power at a reduced rate, which circuit means is adapted to be continuously electrically powered by such a battery unit, so that such a battery unit is capable of operating the alarm system for more than twice the period of time that such a battery unit would be able to operate the system without said circuit means, said circuit means carried by said housing member;

sensor means carried by said housing member and connected to said circuit means, which sensor means is activated by movement or agitation of said housing member; and signal means carried by said housing member and connected to said circuit means and to said sensor means, which signal means is activated when said sensor means is activated.

2. The electrically powered alarm system of claim 1 including, in combination in addition to said first recited sensor means, a second sensor means carried by said housing member and connected to said circuit means, which second sensor means is activated by tilting of said housing member, and which activates said signal means when it is activated.

3. The electrically powered alarm system of claim 1 including in combination a tampering sensor carried by said housing member and connected to said circuit means.

4. The electrically powered alarm system of claim 1 including in combination an indicator means which shows whether the alarm is functioning, whether any such battery trait has stored energy or no energy, and whether the circuit or sensor has failed, carried by said housing member and connected to said circuit means.

5. An electrically powered independent alarm system, including in combination:

a housing member;

circuit means for the alarm system for consuming electric power at a reduced rate, said circuit means carried by said housing member and including a battery as the electrical power source, said circuit means being pulsed to conserve energy;

agitation sensor means carried by said housing member and connected to said circuit means, which agitation sensor means is activated by movement or agitation of said housing member;

tilt sensor means carried by said housing member and connected to said circuit means, which tilt sensor means is activated by tilting of said housing member;

first signal means carried by said housing member and connected to said circuit means, which first signal means is activated when either said agitation sensor means or said tilt sensor means are activated;

indicator means connected to said circuit means to indicate whether the system is operating, and also to indicate whether the battery has stored energy, or no energy;

second signal means carried by said housing member and connected to said circuit means; and a tampering sensor which, when triggered, causes said second signal means to be activated.

6. The electrically powered independent alarm system, of claim 5, wherein said indicator is an LED.

7. The electrically powered independent alarm system, of claim 5, wherein said housing member is selected from the group consisting of frame housing members and panel housing members which is sized and dimensioned to be located at a position selected from the group of positions adjacent to a building opening, within a building opening, adjacent to a wall, within a wall, adjacent to a ceiling, within a ceiling, and adjacent to a specific to-be-projected object.

8. An electrically powered independent alarm system, including in combination:

a housing member which is independent from the surrounding environment, and which requires no connection to an external electrical power source;

circuit means for the alarm system for consuming electric power at a reduced rate, said circuit means carried by said housing member, which circuit means are continuously electrically powered;

agitation sensor means carried by said housing member and connected to said circuit means, which agitation sensor means is activated by movement or agitation of said housing member;

tilt sensor means carried by said housing member and connected to said circuit means, which tilt sensor means is activated by tilting of said housing member; and signal means carried by said housing member and connected to said circuit means, which signal means is activated when either said agitation sensor means or said tilt sensor means are activated.

9. The electrically powered independent alarm system, of claim 8, wherein said circuit means is pulsed to conserve energy.

10. The electrically powered independent alarm system, of claim 8, wherein there is included as an electrical power source a battery, and said circuit means includes continuously electrically powered indicator means to indicate whether the system is operating, and also to indicate whether said battery has stored energy or no energy.

11. The electrically powered independent alarm system, of claim 10, wherein said indicator is an LED.

12. The electrically powered independent alarm system, of claim 8, wherein said system includes a tampering sensor which, when triggered, causes a signal to be activated.

13. The electrically powered independent alarm system, of claim 12, wherein second signal means are carried by said housing member and connected to said circuit means, which second signal means is activated when said tampering sensor is activated.

14. The electrically powered independent alarm system, of claim 8, wherein said housing member is selected from the group consisting of frame housing members and panel housing members.

15. The electrically powered independent alarm system, of claim 14, wherein said housing member is sized and dimensioned to be located at a position selected from the group of positions adjacent to a building opening, within a building opening, adjacent to a wall, within a wall, adjacent to a ceiling, within a ceiling, and adjacent to a specific to-be-projected object.

16. The electrically powered independent alarm system, of claim 14, wherein said housing member is designed to be swingably suspended from a window frame, a ceiling or a separate frame.

* * * * *